United States Patent [19]

Corsette

[11] Patent Number: 4,640,443

[45] Date of Patent: Feb. 3, 1987

[54] MANUALLY OPERATED DISPENSING PUMP

[76] Inventor: Douglas F. Corsette, 6559 Firebrand St., Los Angeles, Calif. 90045

[21] Appl. No.: 689,783

[22] Filed: Jan. 8, 1985

Related U.S. Application Data

[63] Continuation-in-part of Ser. No. 502,274, Jun. 8, 1983, Pat. No. 4,494,680, and Ser. No. 502,273, Jun. 8, 1983, Pat. No. 4,511,065, each is a continuation-in-part of Ser. No. 121,223, Feb. 13, 1980, Pat. No. 4,402,432.

[51] Int. Cl.[4] ..... B05B 11/00

[52] U.S. Cl. ..... 222/321; 222/375; 222/378; 222/380; 222/545

[58] Field of Search ..... 222/372, 375, 378, 476, 222/401, 380, 381, 383, 385, 545

[56] References Cited

U.S. PATENT DOCUMENTS

| | | | |
|---|---|---|---|
| 1,612,149 | 12/1926 | Ouimet | 222/378 X |
| 3,391,647 | 7/1968 | Corsette et al. | 222/385 X |
| 3,458,090 | 7/1969 | Scoggin . | |
| 3,653,556 | 4/1972 | Moran et al. . | |
| 3,908,870 | 9/1975 | Nozawa et al. | 222/321 |
| 3,990,611 | 11/1976 | Sojka . | |
| 4,050,613 | 9/1977 | Corsette . | |
| 4,088,425 | 5/1978 | Bennett | 222/380 X |
| 4,179,049 | 12/1979 | Umstead | 222/380 X |
| 4,218,198 | 8/1980 | Kutik et al. | 222/383 X |
| 4,245,967 | 1/1981 | Busselet . | |
| 4,402,432 | 9/1983 | Corsette . | |
| 4,410,107 | 10/1983 | Corsette | 222/380 X |
| 4,494,680 | 1/1985 | Corsette | 222/380 X |
| 4,503,997 | 3/1985 | Corsette | 222/385 X |
| 4,511,065 | 4/1985 | Corsette | 222/153 |
| 4,591,077 | 5/1986 | Corsette | 222/383 X |

FOREIGN PATENT DOCUMENTS

| | | | |
|---|---|---|---|
| 2825428 | 6/1978 | Fed. Rep. of Germany | 222/385 |
| 375103 | 1/1972 | Spain . | |

*Primary Examiner*—Joseph J. Rolla
*Assistant Examiner*—P. McCoy Smith
*Attorney, Agent, or Firm*—Watson, Cole, Grindle & Watson

[57] ABSTRACT

A dispensing pump of the pressure accumulating type includes a reciprocable plunger/accumulator having a discharge valve coaxial with an inlet check valve carried by a stationary pump piston, the valves bearing directly against one another so as to close each other at the end of the plunger downstroke to thereby control the output of the pump.

23 Claims, 7 Drawing Figures

FIG. 1
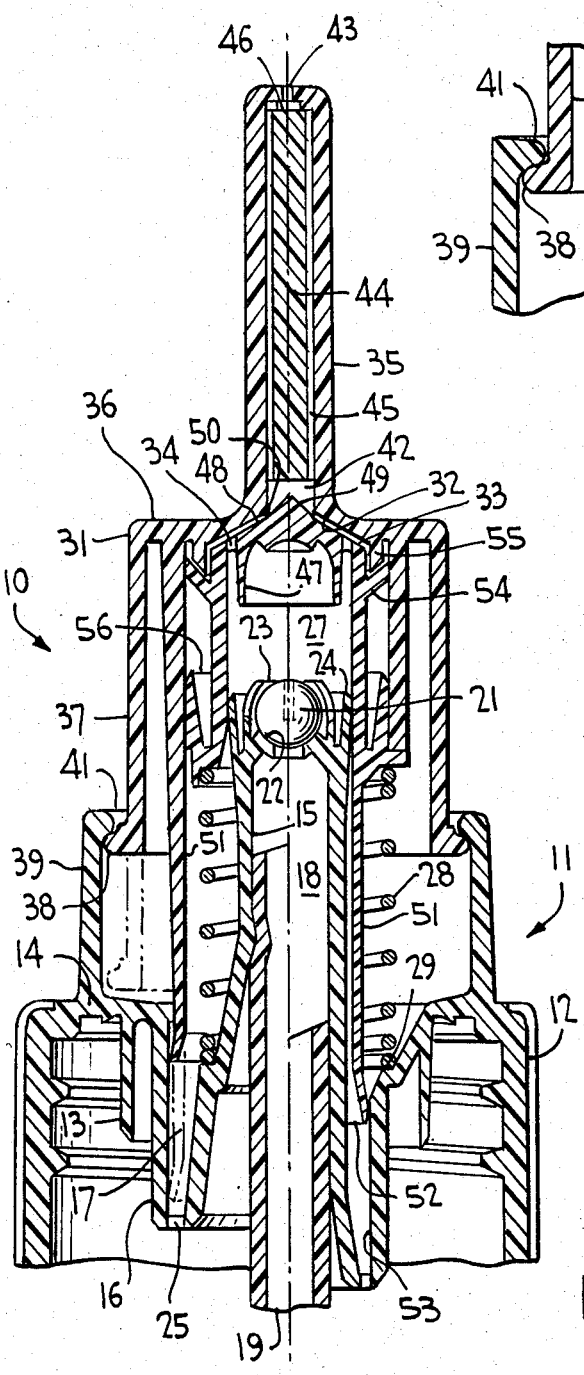
FIG. 2
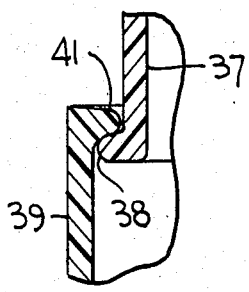
FIG. 3
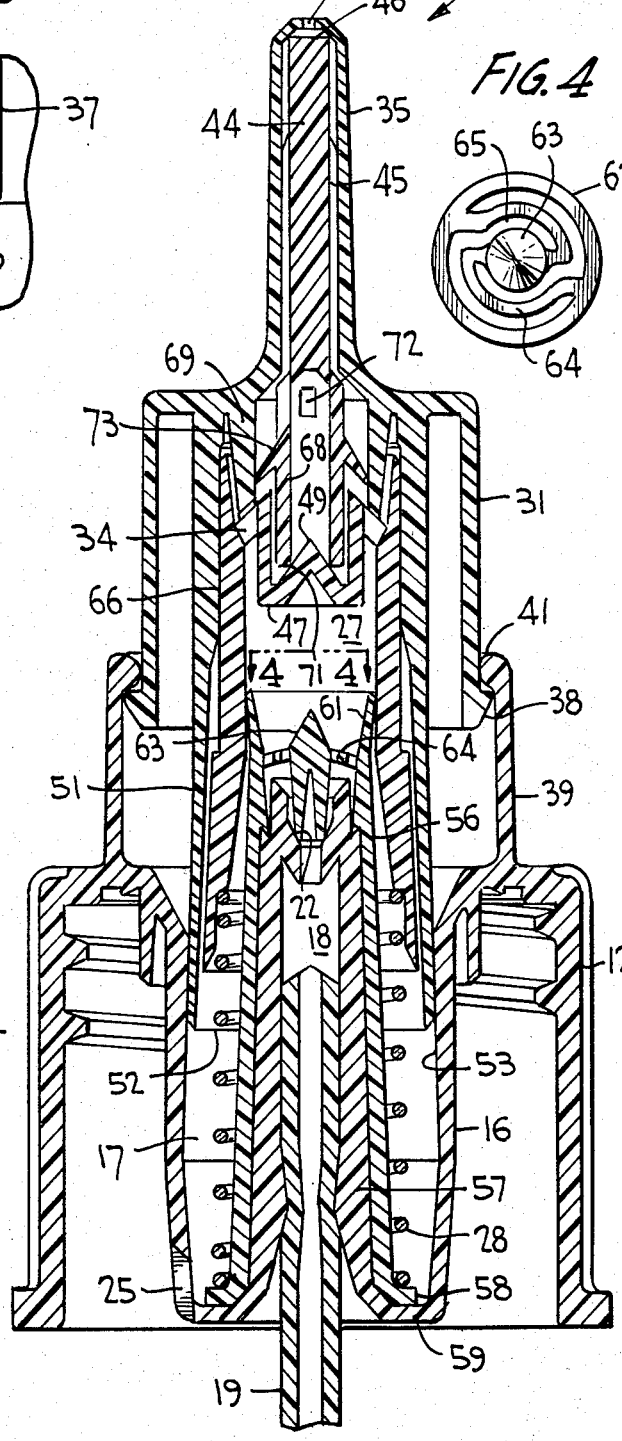
FIG. 4

46
43
44
35
45
10D
49
32
50
33
69
54
83
27
47
31
34
23
21
22
61
41
38
51
39
57
56
12
28
52
53
17
16
25
19

MANUALLY OPERATED DISPENSING PUMP

RELATED APPLICATIONS

This application is a continuation-in-part of U.S. application Ser. No. 502,274, now U.S. Pat. No. 4,494,680, and of application Ser. No. 502,273, now U.S. Pat. No. 4,511,065, both filed June 8, 1983 each as a continuation-in-part of U.S. application Ser. No. 121,223, filed Feb. 13, 1980 and now U.S. Pat. No. 4,402,432.

BACKGROUND OF THE INVENTION

This invention relates generally to a manually operated dispenser, in the form of a sprayer, of the pressure accumulating type, and represents alternative embodiments over the sprayers according to my U.S. Pat. Nos. 4,494,680 and 4,511,065, which are in turn improvements over my earlier U.S. Pat. No. 4,050,613. Specifically, the manually actuated pump according to the present invention has an upright discharge nozzle facilitating its use as a nasal sprayer, for example, and is structured to facilitate accurate output control of the sprayer.

In the manually actuated dispensing pump according to my U.S. Pat. No. 4,494,680 the plunger is isolated from lateral or eccentric forces which may be applied to the plunger head, so that the plunger which functions as a discharge valve is free from restraint by frictional engagement due to opposing force couples or lateral pressure and will therefore respond continuously and promptly in the intended operating mode in balance between the hydraulic pressure and opposing spring force. The pump has spaced bearing members for guiding the plunger head to effect isolation of the plunger during operation.

Another feature of such dispensing pump includes the plunger having a perforated top wall defining a surface facing the upper end of the piston and complementarily contoured thereto, such wall permmitting the plunger to bottom out against the upper end of the piston before the end of the plunger head downstroke thereby allowing for further depression of the head so that it will continue to expel product through the discharge passage upon further depression thereof as the plunger moves into its discharge closing position.

And, in the manually actuated dispensing pump according to my U.S. Pat. No. 4,511,065 the piston is separate from the pump body and is of a softer and more pliant material than the pump body, to thereby achieve a rugged and durable pump body which includes the closure cap, while at the same time obtaining an improved piston quality with improved piston lip seal definition.

The present dispenser provides for upright discharge, in the form of a nasal sprayer, while at the same time facilitates accurate control of the sprayer output. Nasal sprayers having upright discharge are known, as are dispensers providing for controlled output, as set forth in U.S. Pat. No. 4,245,967. However, such a sprayer is not of the pressure accumulating type but rather requires lost motion between the plunger and piston to open the discharge. Moreover, the amount of spray is controlled by the length of a filler element on the piston for controlling its stroke.

Other controlled output or precise dosage dispensers are disclosed in, for example, U.S. Pat. Nos. 3,458,090, 3,653,556, 3,990,611 in the form of adjustable stroke pumps. Again, these are not dispensers of the pressure accumulating type to which the invention is directed.

SUMMARY OF THE INVENTION

It is therefore an object of the present invention to provide an optional arrangement for a manually operated dispensing pump of the pressure accumulating type generally described above, by having an upright discharge in which the discharge and inlet valves are positively closed at the end of the plunger downstroke for accurately controlling the output.

Another object of this invention is to provide such a pump wherein the plunger is isolated from lateral or eccentric forces which may be applied to the plunger head, so that the plunger which functions as a discharge valve is free from restraint by frictional engagement due to opposing force couples from lateral pressure and will therefore respond continuously and promptly in the intended operating mode in balance between the hydraulic pressure and opposing spring force.

Another object of the present invention is to provide such a dispensing pump wherein the upper end of the plunger has a wall defining a surface facing the upper end of the piston and complementarily contoured thereto, the wall being perforated for maintaining communication between the pump and accumulation chambers, and the wall including a discharge valve for controlling the discharge passage. The plunger wall thus permits the plunger to bottom out against the upper end of the piston before the end of the plunger head downstroke thereby allowing for further depression of the head so that it will continue to expel product through the discharge passage upon further depression thereof as the plunger moves into its discharge closing position. And, the inlet and discharge valves bear directly against each other in a coaxial direction to thereby close each other upon the further depression of the head to effect metered dosage of product.

A still further object of the invention is to provide such a pump having a separate piston of softer and more pliant material than the pump body for achieving improved piston quality and improved piston definition.

Other objects, advantages and novel features of the invention will become more apparent from the following detailed description of the invention when taken in conjunction with the accompanying drawings.

BRIEF DESCRIPTION OF THE DRAWINGS

FIG. 1 is a vertical sectional view of an embodiment of a dispensing pump according to the invention;

FIG. 2 is a vertical sectional view showing a part of a plunger head skirt and collar skirt, according to another embodiment of the invention.

FIGS. 3 and 5 to 7 are views similar to FIG. 1 of other embodiments of the invention; and FIG. 4 is a view taken substantially along the line 4—4 of FIG. 3.

DETAILED DESCRIPTION OF THE INVENTION

Figure 5:
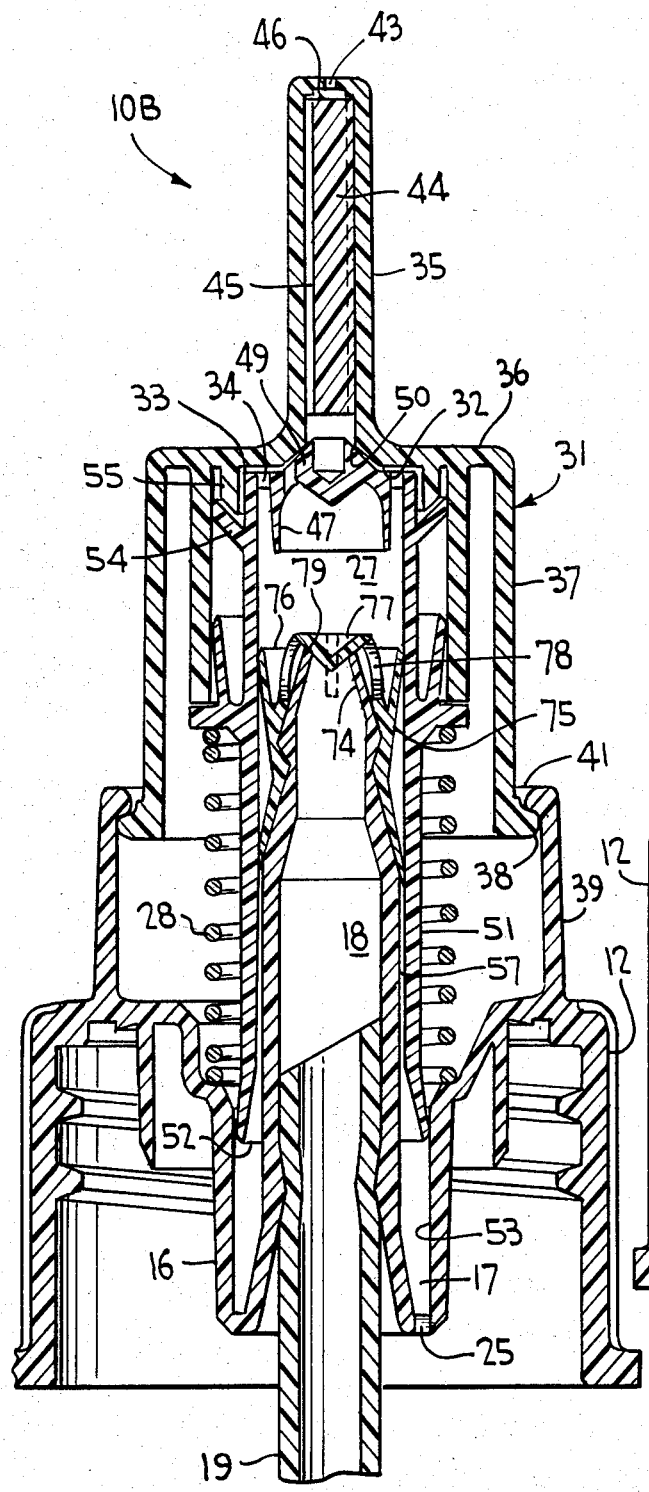

Turning now to the drawings wherein like reference characters refer to like and corresponding parts throughout the several views, FIG. 1 illustrates a manually operated dispensing pump 10 in the form of a nasal sprayer capable of accurately controlling the output, but otherwise structured the same as that shown in my U.S. Ser. No. 502,274. And, the present pump functions similarly as my dispensing pump of the pressure accumulating type according to U.S. Pat. No. 4,050,613. The entirety of this patent is therefore specifically incorporated herein by reference.

Pump assembly 10 of the invention comprises a pump body 11 which includes an integrally formed closure cap 12 which may be internally threaded for securing the pump body in a liquid tight manner over a similarly threaded neck of a container (not shown), which is adapted to hold a flowable product to be dispensed. Otherwise, the closure cap may be adapted for snapping it in place over the opening of the container, or the cap may be separate from the pump body for snapping or threading it in place. An annular sleeve 13 may depend from an upper wall 14 of the pump body and extends into the container neck for enhancing the fluid tight seal between the pump body and the container.

A stationary, hollow upstanding piston 15 is integrally formed on upper wall 14 via an annular wall 16 which surrounds the base of the piston in spaced relationship and defines together therewith a container vent chamber 17. The piston has an inlet passage 18 extending therethrough into which a conventional dip tube 19 is coupled in any normal manner, the dip tube having its lower end extending into the product to be dispensed from the container. A ball check valve 21 and ball seat 22 may be provided at the upper end of the piston for valve controlling the inlet passage, and a plurality of ball retention detents or fingers 23 surround the ball check valve in spaced relation to permit unseating thereof during the suction stroke. And, the upper end of the piston terminates in an annular lip seal 24 which flares slightly outwardly in the normal manner.

At least one container vent port 25 is located in the lower portion of the vent passage and facilitates equalization of pressures within and outside the container as in the conventional manner so as to replace the product dispensed from the container with air to avoid collapse of the container and a vaccuum lock condition within the pump. Moreover, port 25 serves as a sump dump or drain hole through which any seepage of product from around the piston or the accumulator is directed back into the container. Chamber 17 thus functions also as a sump chamber into which the seepage of product is directed.

An annular plunger or accumulator 36 surrounds the pump piston, snugly embraces the same at its lip seal 24 and reciprocates relative thereto so as to therewith define a variable volume pump chamber 27. A return spring 28 extending between the underside of the plunger and a shoulder 29 formed on the pump body resiliently urges the plunger upwardly toward a fully raised position above the pump body.

A plunger head 31 has a downwardly directed blind socket 32 and defines therewith an enclosed variable volume accumulation chamber 33 in open communication with pump chamber 27 via one or more ports 34. This accumulation chamber has an appropriately larger diameter than the pump chamber.

An upstanding, elongated discharge nozzle 35 extends from the plunger head, and the head is capable of being reciprocated by the operator as the fingers thereof typically straddle the nozzle and bear against an upper surface 36 of the head. Thus, intermittent finger pressure conveniently applied to the plunger head may be transmitted to the plunger for producing reciprocation thereof on stationary piston 15, each depression of the plunger being yieldably resisted by spring 28 which returns the plunger to its fully raised position each time finger pressure on the head is relieved.

The plunger head 31 has an outer, annular depending skirt 37 terminating in an outwardly extending retention bead 38 which is outwardly dimensioned to be guided as it slides along the inner surface of an upstanding collar or skirt 39 on the pump body. The upper end of collar 39 has an inwardly extending retention bead 41 which cooperates with bead 38 for limiting upward movement of the plunger head at the predetermined position. However, these retention beads, or stop shoulders, need not sealingly interengage since leakage of product through the container vent opening in the raised position of the plunger and plunger head shown in FIG. 1, is otherwise positively prevented.

The plunger head includes a discharge passage 42, the lower inlet end or port of which is coaxial with the piston and the inlet check valve, and the discharge passage terminating in a discharge orifice 43. An elongated plug 44, having external axial grooves 45, is mounted in any convenient manner within nozzle 35 so as to define feed channels of the discharge passage. An upper terminal end wall 46 of the plug defines a backup wall for a spin chamber formed between this wall and the discharge orifice, the spin chamber being provided in any normal manner as with tangential openings effecting a swirl and misting of the product prior to discharge through orifice 43. Thus, dispensed product is conveyed through the discharge path formed in the nozzle from the accumulation chamber during pumping operation, as the discharge path opens into the blind socket below the blind upper end of the plunger at a location such that this upper end is normally covered by the plunger when the latter is projected into its fully raised position of FIG. 1 into the blind end of socket 32 by spring 28.

A contoured surface 47 is disposed at the upper end of the plunger as an integral part thereof. This surface includes a cover wall 48 slightly spaced from the underside of the plunger head which includes the through port or ports 34 for maintaining open communication between the pump chamber and the accumulation chamber. The annular upwardly presented area of the plunger is exposed to downward fluid pressure within the accumulation chamber in opposition to the upward thrust of return spring 28.

Contoured surface 47 projects into pump chamber 27 partially displacing the air volume therein. This contoured surface is shaped to match the contour at the upper end of the piston, including the inlet ball check valve and ball retention fingers as well as lip seal 24. Thus, upon depression of the plunger head, contoured surface 47 bottoms against the stationary piston and ball check valve before the plunger head reaches the end of its discharge stroke. The hydraulic pressure in the accumulation chamber upon plunger head depression maintains the head slightly spaced from the plunger during downstroke of the head so that, as this downstroke continues, the head is urged downwardly against the hydraulic pressure by the continuing finger force expelling the product above the plunger as part of the normal discharge stroke.

Thus, "after spray" is avoided by mechanically assisting the plunger closing action at the end of the discharge stroke to thereby avoid any dribbling or dripping of product through the discharge at the end of the discharge stroke. This is essentially the operation described for the pump in my parent application Ser. No. 502,274.

However, in accordance with the present invention, the inlet end or port of the discharge passage is coaxial with the piston and inlet check valve, and wall 48 at the upper end of the plunger carries a discharge valve 49, which may be of conical or other geometric configuration, for controlling the discharge port relative to its confronting discharge valve seat 50 defined at the root end of nozzle 35. The discharge valve thus lies coaxial with the piston and inlet check valve, such that plunger head 31 acts to close the discharge valve at the end of the pumping stroke by engaging the inlet valve at the aforedescribed further depression of the head. In other words, the positive closing of both the discharge and inlet valves against inertial overrun by the decaying stroke is assured by direct action of the two valves against each other as the plunger head reaches the end of the pressure stroke. Thus, at the end of the plunger downstroke as the contoured surface at the upper end of the plunger bottoms out against the piston and inlet valve, and upon further depression of the head which continues to expel product until the discharge valve is seated, it is possible to control the output of the sprayer accurately enough to effect metered dosage per stroke of the pump.

The opening and closing of vent chamber 17 during plunger reciprocation is carried out in substantially the same manner as that disclosed for the pumps shown in my prior U.S. Pat. No. 4,402,432. Thus, an annular vent skirt 51, which controls the opening and closing of the vent, depends from the plunger as shown for the version to the right of the centerline in FIG. 1, or depends from the plunger head as shown to the left of the centerline of the version shown in this Figure, and terminates in an annular vent seal 52 which sealingly engages inner surface 53 of wall 16, as shown in the upwardly extended, vent closed position of FIG. 1. This inner surface 53 may have a slight outwardly conical taper as it extends from the upper to the lower ends of the vent chamber so that a gradually increasing annular gap is formed between vent seal 52 and surface 53 as the plunger extends to its phantom outline position on depression of the head. In this position, the container interior communicates with the atmosphere through vent port 25 and open vent chamber 17 outwardly of the pump. Also, any seepage of product from around the piston or the accumulator is directed into the container through the open chamber 17 and port 25.

The upper end of the plunger/accumulator 26 is contoured to match the confronting underside of the plunger head, and has an outwardly extending flange 54 in sliding engagement with the confronting wall of the accumulation chamber which delimits the outer extent of the accumulation chamber, and a ring 55 depends from the upper end of the plunger head toward flange 54 for dispatching air for priming. Flange 54, which does not seat against rib 55 in the fully raised and discharge valve closing positon of the plunger of FIG. 1, also serves to guide the plunger coaxially within the accumulation chamber so that the full force of the plunger acts against the discharge valve seat in positively closing the discharge valve and in preventing leakage during shipping and storage. The lower end of the plunger is reversely bent to define a lip seal 56 in sealing engagement with the inner surface of the head bore which may also incorporate vent skirt 51.

The structure of the present pump assembly as aforedescribed is such that the plunger head axis is coaxial with the axis of the pump body and is maintained substantially coaxial with the pump body, including the collar, vent chamber and stationary piston positions, throughout plunger head reciprocation. The same venting performance is achieved as described in my parent application Ser. No. 502,274 since vent skirt 51 functions within the vent chamber together with and in response to reciprocation of the plunger head. However, in addition to the venting function, vent skirt 51 serves also as an aligning element together with retention bead 38 which respectively glide along inner surface 46 and the inner surface of collar 39. Thus, the plunger head is permitted to reciprocate axially between stop limits while being maintained with its axis congruent with the pump body axis including especially collar 39, the vent passage, and the stationary piston portions. With this lateral axial control, the plunger head can experience various non-axial forces without cocking its axis, or otherwise losing axial congruency. Therefore, the mis-application of lateral or eccentric forces to the plunger head during reciprocation is prevented from transmitting any bias or restraining force to the plunger. Thus, the plunger, which functions as the discharge valve and pressure regulating element, is free floating between the spring force below and the hydraulic force above and is not restrained against movement in response to these forces. An example of the effect of lateral or eccentric forces on the plunger head is the action wherein the lateral or eccentric forces thereon induce a frictional load between the plunger and its valving elements which can permit the plunger to be momentarily held open at the end of the plunger downstroke with a small quantity of product remaining within the discharge path. When the actuating force on the head is relieved, even slightly, the frictional holding force or brake is relaxed. This then causes the spring to shift the plunger immediately to its closed position. Thus, the small amount of product which had been left in the discharge path at the end of the plunger discharge stroke is now suddenly charged at the start of the plunger intake stroke as the plunger closes in response to spring pressure. This unexpected discharge at the start of the recharge stroke is at least inconvenient and should be avoided. Since the present plunger cannot be partially or wholly restrained by frictional engagement due to opposing force couples or lateral pressure, it will respond continuously and promptly in the intended operating mode in balance between the hydraulic pressure and opposing spring force.

The plunger/accumulator, in the version to the left of the centerline in FIG. 1, without a vent skirt and with the interfacing air displacement integral contour, becomes a free floating member responding to the opposing and hydraulic spring forces plus normal frictional factors. The plunger head carries vent skirt 51 having vent seal 52 which engages inner surface 53 of the vent chamber as a vent valving member, and which also serves as an alignment guide cooperating with head retention bead 38 as bearing members spaced apart axially to resist lateral or eccentric forces on the plunger head, and to isolate such forces from the plunger/accumulator. Thus, each member of the pump assembly which slides relative to its facing member is held with its axis congruent with all other cooperating members, to thereby eliminate detrimental counter-productive couples which may mitigate the performance of the assembly to an objectionable extent.

A plunger head skirt 37 and a cooperating collar skirt 39 are shown in FIG. 2 in accordance with a variant of another pump assembly not otherwise shown, but likewise set forth in my parent application Ser. No. 502,274. Thus, retention bead 41, rather than bead 38, functions as a bearing member as it is guided along the outer surface of skirt 37 during plunger reciprocation. With such an arrangement, it can be seen that, upon inward movement of the plunger, the bearing separation between 41 and 52 is increased thereby enhancing plunger head stability.

The further embodiments represented by FIGS. 3 and 5 to 7 comprise sprayers which are structured essentially the same as and which function in an identical manner to that described with reference to FIG. 1. Thus, like parts will be identified by the same reference numerals. The stationary piston of pump 10A shown in FIG. 3 comprises a hollow, sleeve-like piston member 56 mounted on an upstanding hollow port 57 which is integrally formed with wall 16 and includes inlet passage 18 in which dip tube 19 is seated. Piston 56 surrounds the post in frictional engagement and has a lower annular flange 58 seated against a connecting wall 59 of the pump body and firmly held in place by spring 28. The piston has an annular lip seal 61 at its upper end which supports an inlet check valve 62 (FIG. 4) which includes a central valve stud 63 connected to the lip seal by a plurality of flexible straps 64, defined by openings 65 which may be of maze-like configuration. The stud has a formed upper end which matches confronting surface 47, and is resiliently urged at its lower end against inlet valve seat 22 by the flexible straps. Product flows through openings 65 when the inlet valve is unseated in response to changes in pressure within the pump chamber.

An annular plunger or accumulator 66 surrounds the pump piston, snugly embraces the same at its lip seal 61 and reciprocates relative thereto so as to therewith define the variable volume pump chamber 27. Return spring 28 extends between the underside of the plunger and flange 58 formed at the lower end of the piston so as to urge the plunger upwardly toward its fully raised position above the pump body.

Plunger head 31 has a downwardly directed blind socket 32 and defines therewith an enclosed variable volume accumulation chamber 33 in open communication with pump chamber 27 via one or more ports 34.

The plunger has a cover wall 67 at its upper end with a central depression into which a hollow lower end 68 of plug 44 projects. The cover wall is spaced from the exterior of hollow end 68 and is disposed slightly below an annular rib 69 depending from the plunger head. And, the cover wall includes discharge valve 49 which is seated against a valve seat 71 formed at the lower inner edge of hollow end 68. One or more ports 72 are located in hollow end 68 through which product issues from the open discharge valve and through the outlet orifice via the discharge passage. And, a downwardly sloping flange 73 on hollow end 67 sealingly engages the inner surface of rib 69 so as to confine the discharge passage to the interior of end 67 and port or ports 72. As in FIG. 1, contoured surface 47 at the underside of cover wall 67 is shaped to match the contour at the upper end of the piston, including the inlet check valve. And, the underside of the plunger head is shaped to match the contour at the upper end of the plunger.

The pump body which includes the closure cap, may be of a hard and durable material (for example, polypropylene) to withstand the pump assembly mounting operation and to ensure a tight and leakproof fit with the neck of the container. On the other hand, separate piston member 56 may be of a softer and more pliant material than that of the closure cap to give good definition which allows it to precisely conform to the inner diameter of plunger 66 and to any out-of-round or other irregularities thereof. Thus, the piston member may be formed of a high-density polyethylene material, or the like. It is thus assured that any leakage of product from the pump chamber around lip seal 61 is positively avoided.

And, plunger head 31 may be of the same rigid material as that of closure cap 12, preferably polypropylene, to withstand repeated manipulation during the pumping operation. On the other hand, plunger 66 may be of a relatively softer and more pliant material, such as a polyethylene, to give good definition to vent seal 52 which must conform precisely to the inner diameter of wall 16 and to any of its irregularities, such as an out-of-roundness and the like. By making the piston separate from the closure cap and more compliant, these parts are rendered more suitable for the purposes intended and gives rise to the production of a high quality piston from a wider choice of materials. And, as will be seen, this allows for a wider selection of differently styled pistons/inlet valves.

Dispensing pump 10B of FIG. 5 has its stationary piston formed by upstanding post 57 which supports a surrounding hollow sleeve-like piston 75 having an annular lip seal 76 at its upper end. The piston also has an integrally molded valve shown in the form of a flexible poppet valve 77 having inlet ports 78 therein. The valve is appropriately shaped and is normally seated against a valve seat 79 formed at the upper end of post 57 for closing the inlet passage through the hollow post during the compression stroke, the valve flexing upwardly and becoming unseated from its valve seat for opening the inlet passage only during a suction stroke.

Again, the upper end of the plunger includes a contoured surface 47 of an appropriate shape which matches that of the piston and inlet check valve, and the cover wall on the plunger carries discharge valve 49, similarly to that described with reference to FIG. 1 in function and operation. And, the pump body which includes the closure cap may be formed of a hard and durable material such as polypropylene, while the piston skirt may be formed of a softer and more pliant material such as a high-density polyethylene, both for the purposes described with reference to FIG. 3.

Figure 6:
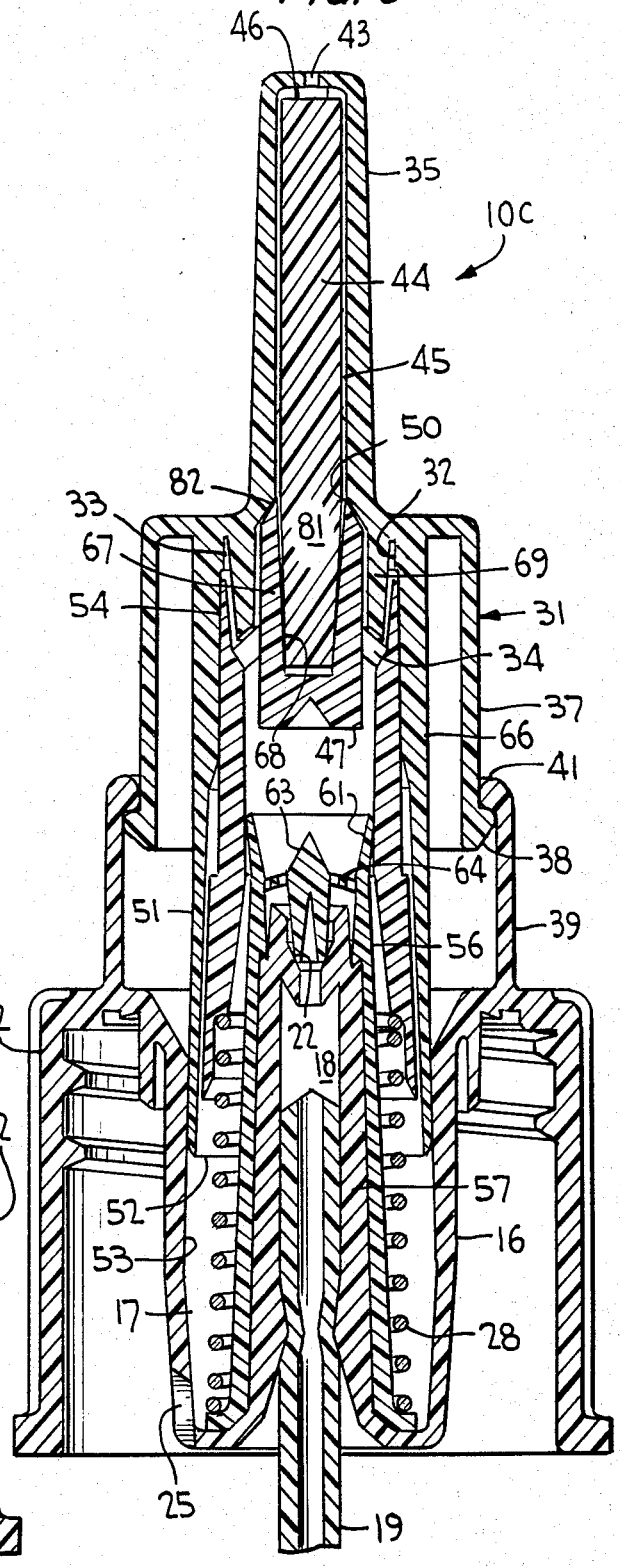

Pump 10C of FIG. 6 is similar to pump 10A of FIG. 3 except for the discharge valve. Thus, cover wall 67 at the upper end of the plunger has a central depression 68 into which a solid end 81 of plug 44 extends in loose relationship. And, a conical wall 82 at the uppermost end of cover wall 67 defines a discharge valve shown seated against its valve seat 50 defined at the inner edge at the root of nozzle 35. The undersurface of cover wall 67 is contoured as at 47 to match the shape of the inlet check valve and piston at its upper end. The separate piston and plunger may be formed of a softer and more pliant material as for the purpose and in the manner described with reference to FIGS. 3 and 5.

Figure 7:
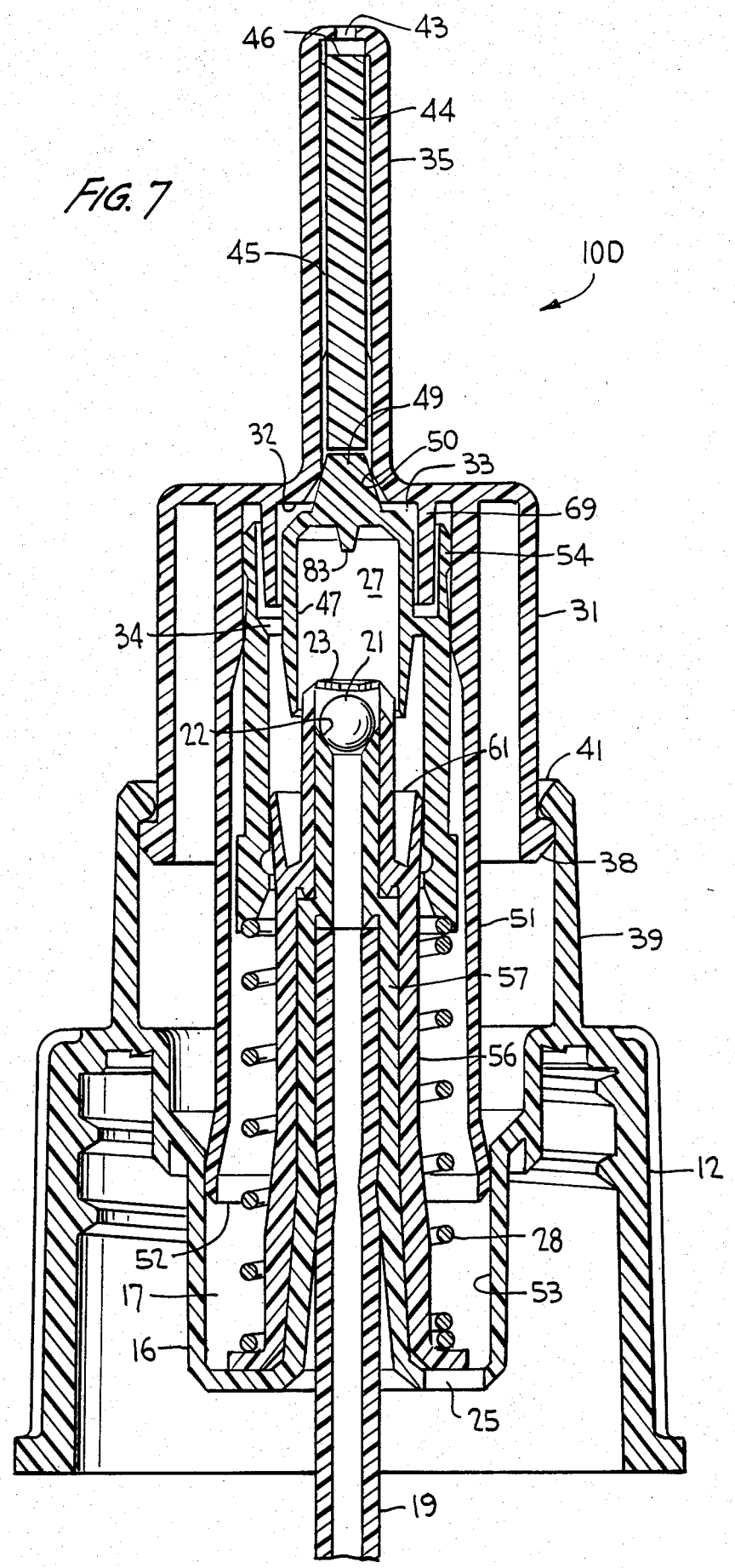

Pump 10D of FIG. 7 is similar to the aforedescribed pumps except that an inlet ball check valve 21 is carried at the upper end of post 57, and a plurality of ball retention detents or fingers 23 at the upper end of the piston 56 surround the ball check valve in spaced relationship to permit unseating thereof during the suction stroke. Also, the upper end of post 57 and of the piston project upwardly from lip seal 61 on the piston, and the cover wall on the plunger has its undersurface contoured at 47 so as to match the shape at the upper end the piston and inlet check valve. Such a contour includes a short depending pin 83 which bears directly against ball check valve 21 at the end of the pumping stroke. Otherwise, the various parts of pump 10D may be of materials similar to that described with reference to FIGS. 3, 5 and 6 for the same purposes.

From the foregoing, it can be seen that an optional structural arrangement in the form of a so-called nasal sprayer is available for my pressure accumulating-type dispensing pump which likewise functions to avoid any dribbling and dripping of product from the discharge at the end of the plunger discharge stroke. And, the plunger/accumulator is developed as free floating and having at its upper end an air displacement interfacing the contour for assuring continuous and quick response in the intended operating mode, for mechanically effecting a discharge valve closing assist at the end of the plunger discharge stroke, and for effecting a more accurate control of the sprayer output. Furthermore, a more compliant piston member may be provided without restricting the selection of material required for that of the pump body which includes the closure cap, since the two parts are separate and are comprised of different materials which satisfy different needs.

Terms of orientation, such as "upstanding", "upper", "lower", "upward" and "depending", are used to lend clarity to identify the orientation relative to the drawings. These terms are therefore not intended to limit the scope of the invention or to exclude any equivalent structure.

Obviously, many modifications and variations of the present invention are made possible in the light of the above teachings. It is therefore to be understood that within the scope of the appended claims the invention may be practiced otherwise than as specifically described.

What is claimed is:

1. A dispensing pump comprising, a pump body adapted for fluid tight communication with the opening of a container of flowable product to be dispensed, said pump body including a stationary upstanding piston, a container vent opening, and a collar surrounding said piston, an annular plunger mounted for reciprocation on said piston to define therewith a variable volume pump chamber, said piston having an inlet passage and a coaxial valve for controlling said inlet passage, a plunger head slidably disposed on said plunger for reciprocation and having means defining a variable volume accumulation chamber in open communication with said pump chamber, means resiliently urging said plunger into a fully raised position above said pump body, said head having a discharge passage with an inlet end thereof coaxial with said piston, discharge valve support means at an upper end of said plunger confronting an upper end of said piston and complementarily contoured thereto, said support means including a discharge valve for controlling said discharge passage and having at least one passageway extending therethrough for maintaining the open communication between said chambers, retention beads on said plunger head and on said collar for limiting said plunger head in a predetermined raised position wherein said plunger closes said discharge passage in said fully raised position thereof, said retention beads extending laterally respectively toward confronting surfaces of said collar and said plunger head, one of said beads defining a first annular bearing member in sliding engagement with one of said confronting surfaces during plunger head reciprocation, said pump body further including an upstanding annular wall spaced from said piston and therewith defining a vent chamber which includes said vent opening, a vent skirt extending from said plunger head and having an annular vent seal defining a second bearing member slidably guided along said wall during said plunger head reciprocation, said vent chamber being adapted to be closed by said vent seal in said fully raised position of said plunger and to be opened by said vent seal during plunger reciprocation, and said bearing members being spaced apart acting to resist any lateral or eccentric forces applied to said head during its reciprocation to thereby isolate said forces from said plunger permitting it to respond without restraint during said movement in opening and closing said discharge passage.

2. The dispensing pump according to claim 1, wherein a plunger skirt extends from said head concentric with said vent skirt, said first and second bearing members being respectively located on said skirts.

3. The dispensing pump according to claim 1, wherein a plunger skirt extends from said head concentric with said vent skirt, said first and second bearing members being respectively located on said collar and said vent skirt.

4. The dispensing pump according to claim 1, wherein said discharge passage is defined by an elongated nozzle on said plunger head.

5. The dispensing pump according to claim 1, wherein said support means comprises a cover wall having at least one port therein defining said passageway.

6. A dispensing pump, comprising a pump body sealingly mounted on a container of flowable product to be dispensed, said body having a container vent opening therein and a stationary upstanding piston thereon, an annular plunger resiliently urged into a fully raised position and mounted for reciprocation on said piston to define therewith a variable volume pump chamber, said piston having an inlet passage and a coaxial inlet valve for controlling said inlet passage, a plunger head slidably disposed on said plunger for reciprocation and having means defining a variable volume accumulation chamber in open communication with said pump chamber, said head also having a discharge passage with its inlet coaxial with said piston, said passage being adapted to be opened and closed by said plunger upon movement in response to a change in pressure within said pump chamber, said pump body further including a vent chamber which includes said vent opening, and a vent skirt on one of said plunger and said plunger head adapted for closing said vent chamber in the raised position of said plunger and for opening said vent chamber during an initial and further downstroke position of said plunger, perforate wall means at an upper end of said plunger confronting the upper end of said piston and being complementarily contoured thereto, said wall means including a discharge valve for controlling said discharge passage, whereby said pump chamber may be effectively primed upon depressing said head, and whereby, after pump priming, said wall means bears against said upper end of said piston at the end of the plunger downstroke while said discharge passage remains open allowing for further depression of said head, so that said plunger head will continue to expel product through said discharge passage upon said further depression before said plunger moves into its discharge closing position, said inlet and discharge valves bearing directly against each other in a coaxial direction to thereby close each other upon said further depression of said head to control the output of the pump.

7. The dispensing pump according to claim 6, wherein said wall means comprises a cover wall slightly spaced from the undersurface of said head in said discharge closing position of said plunger, said cover wall having ports therein for maintaining the open communication between said chambers.

8. The dispensing pump according to claim 6, wherein said discharge passage is defined by an elongated nozzle on said plunger head.

9. The dispensing pump according to claim 6, wherein said plunger has means thereon for guiding said plunger coaxially within the accumulation chamber so that the full force of said plunger acts to close said discharge passage in said discharge closing position.

10. The dispensing pump according to claim 8, wherein said discharge passage is further defined by an elongated plug mounted within said nozzle and defining together therewith coaxial grooves, said plug having a perforate, hollow inner end defining a discharge valve seat.

11. The dispensing pump according to claim 6, wherein said inlet valve comprises a ball check valve.

12. The dispensing pump according to claim 6, wherein said inlet valve comprises a plug-like element resiliently connected to said piston for relative axial movement.

13. The dispensing pump according to claim 6, wherein said inlet valve comprises an annular flange of frustoconical configuration resiliently connected to said piston for relative axial movement,

14. The dispensing pump according to claim 6, wherein said piston comprises a separate piston member, said plunger head and said body each being of a first material having a predetermined hardness for durability and strength, and said piston and said plunger each being of a second material which is softer and more compliant than said first material.

15. A dispensing pump of the pressure accumulating type comprising, a pump body adapted to be secured in a fluid tight manner over the opening of a container of product to be dispensed, said pump body having a container vent opening therein and a stationary upstanding piston thereon, an annular plunger resiliently urged into a fully raised position above said body and being mounted for reciprocation on said piston to define therewith a variable volume pump chamber, said piston having an inlet passage and a coaxial inlet valve for controlling said passage, a plunger head having a downwardly directed blind socket slidably disposed on said plunger and therewith defining a variable volume accumulation chamber between said plunger and the blind end of said socket, and being in open communication with said pump chamber, said plunger head having a discharge passage with its inlet coaxial with said piston, said passage being adapted to be opened and closed by relative movement between said plunger and said plunger head, means for limiting the upward movement of said plunger head at a predetermined position in which said plunger is urged at said fully raised position thereof into said socket to function as a valve for closing said passage, wall means at the upper end of said plunger defining a contoured surface facing the upper end of said piston, said wall means including a discharge valve for controlling said discharge passage, and said wall means having at least one port therein for maintaining the open communication between said chambers, said upper end of said piston being complementarily contoured, whereby said pump chamber may be effectively primed upon depressing said head, and whereby, after pump priming, said contoured surface bears against said upper end of said piston at the end of the plunger downstroke while said discharge passage remains open thereby allowing for further depression of said head which continues to expel product through said discharge passage from said accumulation chamber as said plunger is urged into said socket for closing said passage, said inlet and discharge valves bearing directly against each other in a coaxial direction to thereby close each other upon said further depression of said head to control the output of the pump.

16. The dispensing pump according to claim 15, wherein said wall means defining said contoured surface comprises a cover wall spaced a slight distance from the undersurface of said plunger head in said predetermined position of said plunger.

17. The dispensing pump according to claim 15, wherein said plunger has means thereon for guiding said plunger coaxially within the accumulation chamber so that the full force of said plunger acts to close said discharge passage in a discharge closing position.

18. The dispensing pump according to claim 15, wherein said discharge passage is defined by an elongated nozzle on said plunger head.

19. The dispensing pump according to claim 18, wherein said discharge passage is further defined by an elongated plug mounted within said nozzle and defining together therewith coaxial grooves, said plug having a perforate, hollow inner end defining a discharge valve seat.

20. The dispensing pump according to claim 15, wherein said inlet valve comprises a ball check valve.

21. The dispensing pump according to claim 15, wherein said inlet valve comprises a plug-like element resiliently connected to said piston for relative axial movement.

22. The dispensing pump according to claim 15, wherein said inlet valve comprises an annular flange of frustoconical configuration resiliently connected to said piston for relative axial movement.

23. The dispensing pump according to claim 15, wherein said piston comprises a separate piston member, said plunger head and said body each being of a first material having a predetermined hardness for durability and strength, and said piston and said plunger each being of a second material which is softer and more compliant than said first material.

* * * * *